United States Patent [19]

Apothéloz

[11] 4,007,689

[45] Feb. 15, 1977

[54] BLOCKING MECHANISM FOR AN IMPACT FUZE

[75] Inventor: Robert Apothéloz, Greifensee, Switzerland

[73] Assignee: Werkzeugmaschinenfabrik Oerlikon-Buhrle AG, Zurich, Switzerland

[22] Filed: June 14, 1976

[21] Appl. No.: 696,067

[30] Foreign Application Priority Data

June 27, 1975 Switzerland ..... 8367/75

[52] U.S. Cl. ..... 102/78; 102/76 P

[51] Int. Cl.[2] ..... F42C 1/04; F42C 15/24

[58] Field of Search ..... 102/78, 80, 71, 76 P, 102/70 S

[56] References Cited

UNITED STATES PATENTS

| | | | |
|---|---|---|---|
| 2,625,881 | 1/1953 | Rabinow | 102/78 |
| 2,999,461 | 9/1961 | Apothéloz | 102/78 X |
| 3,631,728 | 1/1972 | Prachar et al. | 102/78 X |

FOREIGN PATENTS OR APPLICATIONS

| | | | |
|---|---|---|---|
| 586,316 | 11/1959 | Canada | 102/78 |

*Primary Examiner*—David H. Brown
*Attorney, Agent, or Firm*—Werner W. Kleeman

[57] ABSTRACT

A blocking mechanism for an impact fuze comprising a spring-loaded blocking sleeve lengthwise displaceable in the fuze housing and provided with at least one radially movable blocking body. The blocking body can be brought by means of a spring-loaded blocking bolt lengthwise displaceable within the blocking sleeve into a position blocking the blocking sleeve in the fuze housing. The fuze housing has a recess into which there can engage the blocking body for blocking the blocking sleeve in a first position. The fuze housing has a further substantially wedge-shaped recess which tapers towards the rear in which there can be wedged the blocking body between a wall of this recess and the blocking bolt, in a second position of the blocking sleeve, for the purpose of securing the blocking bolt against displacement towards the rear.

4 Claims, 6 Drawing Figures

BLOCKING MECHANISM FOR AN IMPACT FUZE

BACKGROUND OF THE INVENTION

The present invention relates to a new and improved construction of a blocking mechanism for an impact or percussion fuze comprising a spring-loaded blocking sleeve lengthwise displaceable in the fuze housing and provided with at least one radially movable blocking body which can be brought into a position blocking the blocking sleeve in the fuze housing by means of a spring-loaded blocking bolt lengthwise displaceable within the blocking sleeve, the fuze housing having a recess in which there can engage the blocking body for blocking the blocking sleeve in a first position.

There is already known to the art from Swiss Pat. No. 328,118 such type blocking mechanism wherein equally there can be blocked the blocking sleeve in a blocking position preventing firing by blocking a transverse slide in that the blocking sleeve pushes the blocking balls into the first recess in the fuze housing. Upon firing of the projectile initially the blocking bolt slides towards the rear, and as a result the blocking balls are freed and the blocking sleeve due to its moment of inertia likewise can move rearwardly. After the projectile has departed from the barrel of the weapon the air resistance causes a deceleration and the blocking bolt and the blocking sleeve strive to again move back into their blocking position. A conical portion at the blocking bolt however presses the balls which have been pressed into the radial bores in the blocking sleeve again apart until they clamp at a shoulder of the fuze housing. Hence, the blocking sleeve remains blocked in the ready-for-firing position where the transverse slide is not prevented from shifting into the live or armed position. Upon impact at the target the firing pin is pressed into the detonator cap arranged in the transverse slide.

Now if the projectile with the unarmed fuze, i.e. with the transverse slide in the blocked position is dropped with the tail-end leading from a given height, for instance 5 meters, onto a hard surface (for instance during testing of the dropping safety of the projectile), then there occurs a brief deceleration in consequence of which the blocking bolt slides rearwardly and the balls are released for a moment. However, until such time as the blocking bolt has arrived at its rearmost position the deceleration is no longer effective and the blocking sleeve no longer strives to move out of its blocking position likewise towards the rear. The blocking bolt again returns to its original position and presses the blocking balls back again into the first recess. If, however, the fuze experiences a greater deceleration, for instance due to dropping of the projectile with its tail-end leading from a greater height onto a hard surface, for instance from a height of 10 meters, then it can happen that the blocking sleeve due to its moment of inertia slides rearwardly to such an extent that the balls pushed into the radial bores arrive in a lengthwise position between both recesses of the fuze housing. The blocking bolt then, upon its return movement, presses the balls against the wall of the fuze housing bore. Due to the resulting frictional forces the forward movement of the blocking sleeve brought about by the spring action is impeded. If the frictional forces are so large that the spring coacting with the blocking sleeve is no longer capable of overcoming such forces (for instance the quality of the surface may have become damaged due to the application of excessive loads during transport), then the blocking sleeve remains in this semi-armed position. Even though the slide is still prevented by the blocking sleeve from shifting into the armed position, nonetheless the transport safety of such a semi-armed fuze is markedly impaired. Now further tail-end falling of the projectile against a hard surface, for instance from a height of 1 meter, is sufficient to release the clamping action of the blocking balls due to the rearwardly moving blocking bolt and the blocking sleeve can slide rearwardly to such an extent until it is blocked in the armed position in that the balls arrive in the second recess i.e. behind the corresponding shoulder in the fuze housing bore. The slide is now free and moves into the armed position. Upon firing of the projectile the gunnery crew is in extreme danger, since the detonation occurs already in the weapon barrel or directly in front of the barrel mouth.

SUMMARY OF THE INVENTION

Hence, it is a primary object of the present invention to provide a new and improved construction of blocking mechanism for an impact fuze which is not associated with the aforementioned drawbacks and limitations of the prior art constructions.

Another and more specific object of this invention is to increase the transport safety of a fuze and to avoid endangering the gunnery crew.

Now in order to implement these and still further objects of the invention, which will become more readily apparent as the description proceeds, the fuze housing is provided with a further substantially wedge-shaped recess tapering towards the rear in which the blocking body, in a second position of the blocking sleeve, can be clamped or wedged between a wall of this recess and the blocking bolt for the purpose of securing the blocking bolt against rearward displacement.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
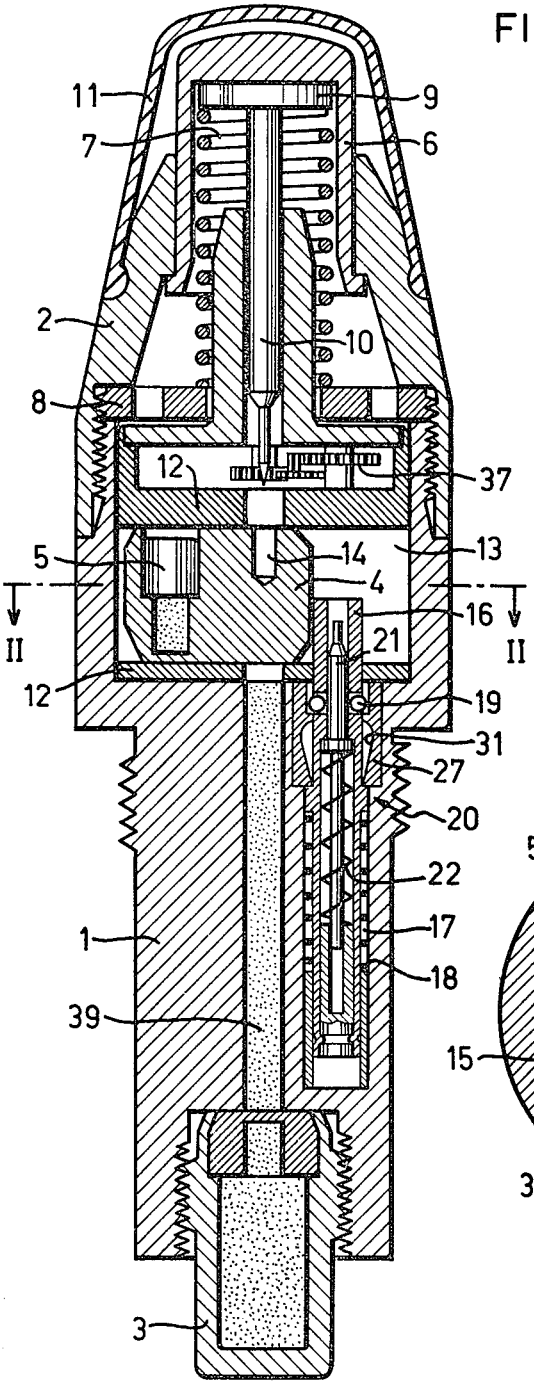
FIG. 1 is a longitudinal sectional view of a first embodiment of impact fuze equipped with a blocking mechanism for a transverse slide.
Figure 2:
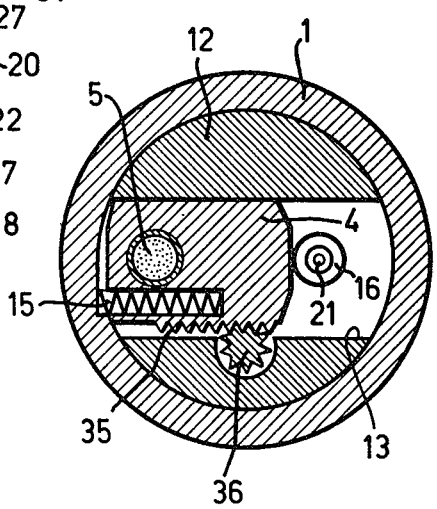
FIG. 2 is a cross-sectional view of the fuze of FIG. 1, taken substantially along the line II—II thereof.

Describing now the drawings, according to FIGS. 1 and 2 there is provided a fuze housing 1 with a threadably connected fuze head 2 and carrying at its rear end a threadably connected detonator 3. An explosive charge cord 39 arranged along the lengthwise axis of the fuze housing 1 constitutes the connection between a detonator cap 5 arranged in a transverse slide 4 displaceable transversely with respect to the fuze axis and the detonator 3. Displaceably mounted in the fuze head 2 is a firing pin sleeve 6. A spring 7 arranged therein bears at one end upon a spring support 8 and at the other end against a firing pin plate 9 of a firing pin 10 in such a manner that the firing pin 10 always is pressed towards the front. A plastic hood 11 mounted upon the fuze head 2 serves as a seal and is sufficiently elastic that whenever it is depressed it always returns back to its original shape. A bearing or support body 12 mounted in the fuze housing 1 contains a groove 13 in which there is displaceably mounted the transverse slide 4. As mentioned, the transverse slide 4 houses the detonator cap 5 and additionally will be seen to possess a blindhole bore 14. In a blocked position of the transverse slide 4, as shown in FIG. 1, the axis of the blindhole bore 14 coincides with the axis of the firing pin 10, whereas the detonator cap 5 is located outside of the region of the firing pin 10.

A spring 15, which is visible from the showing of FIG. 2 and bears against the fuze housing 1, strives to displace the transverse slide 4 into the armed position where the detonator cap 5 is located coaxially with respect to the firing pin 10. However, this is prevented prior to firing of the projectile by a blocking sleeve or bushing 16 of a blocking mechanism 20 which is displaceably mounted in a lengthwise bore 17 within the fuze housing 1 and urged by a spring 18 into its blocking position. Details of the blocking mechanism 20 will be particularly seen by referring to FIGS. 3 to 6. The blocking sleeve 16 possesses a number of radial bores 23. In each radial bore 23 there is arranged for radial movement a blocking body, in the case under consideration a blocking ball 19 or equivalent structure. Within the blocking sleeve 16 there is arranged to be lengthwise displaceable a blocking bolt 21 exposed to the pressure of a spring 22 bearing against the floor of the blocking sleeve 16. The floor of the blocking sleeve 16 is formed by a plug 32 having a peripheral groove 33. The blocking sleeve 16 is connected with the plug 32 by means of a peripheral portion or projection 34 which is pushed into the peripheral groove 33. Of course it would be possible to however use any other different construction to establish this connection.

The blocking bolt 21 has a collar 24 by means of which, when the blocking bolt is in its forwardmost position relative to the blocking sleeve 16, it bears against a shoulder 25 of such blocking sleeve. Further, the blocking bolt 21 is provided at its front end with a substantially conical portion **21*b* serving as the transition between a part or portion 21*a* of the blocking bolt 21 which corresponds to the inner diameter of the blocking sleeve 16 and a tapered part or portion 21*c*. If the blocking bolt 21 is located in its forwardmost position relative to the blocking sleeve 16, then, the larger diameter portion 21*a* of the blocking bolt 21 presses apart the blocking balls 19, resulting in blocking of the blocking sleeve 16. With that position of the blocking bolt 21, where the tapered portion 21*c* is located at the height of the radial bores 23 having the balls 19, these balls 19 can move radially inwards and the blocking sleeve 16** is not blocked against displacement.

The lengthwise or longitudinal bore 17 in the fuze housing 1 possesses at its front a widened portion **17*a* in which there is inserted a sleeve 27. The diameter of the internal bore 28 of the sleeve 27 is smaller than the diameter of the lengthwise bore 17. The sleeve 27 thus forms a shoulder 29 in the lengthwise bore 17 against which bears the blocking sleeve 16 by means of a flange 26 in its forward position. The diameter of the flange 26 corresponds to the diameter of the lengthwise bore 17 and separates a front portion 16*a* of the blocking sleeve 16 corresponding to the inner diameter 28 of the sleeve 27 from a rear portion 16*b* of such blocking sleeve, this rear portion being surrounded by a spring 18 and protruding into a bushing 38 inserted into the lengthwise bore 17. The spring 18 bears at one end at the flange 26, at the other end at the bushing 38.**

Figure 3:
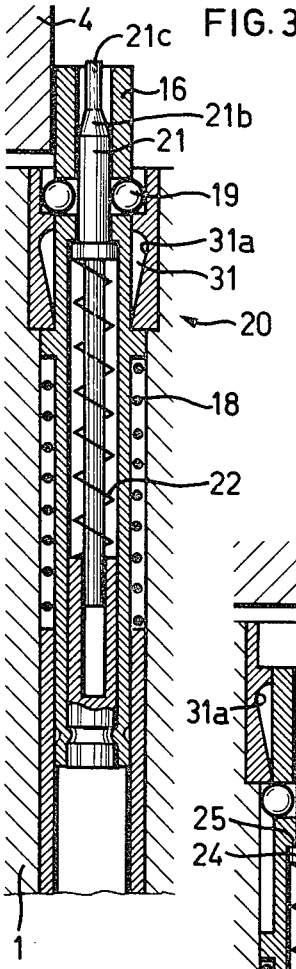
FIG. 3 is a longitudinal sectional view, on an enlarged scale, through the blocking mechanism illustrated in FIG. 1 in a blocking position.
Figure 5:
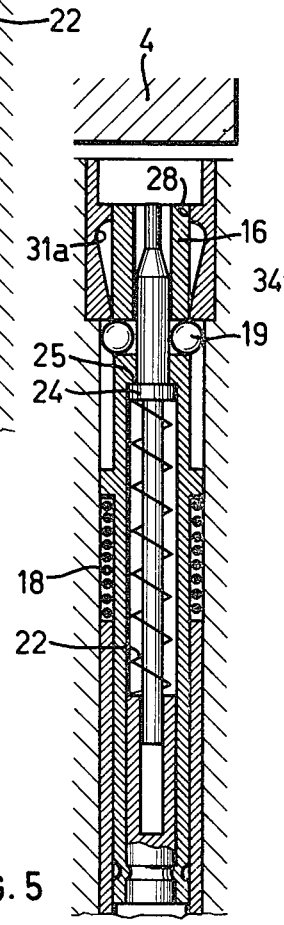
FIG. 5 is a view similar to the showing of FIG. 3 of the blocking mechanism in an armed position.
Figure 6:
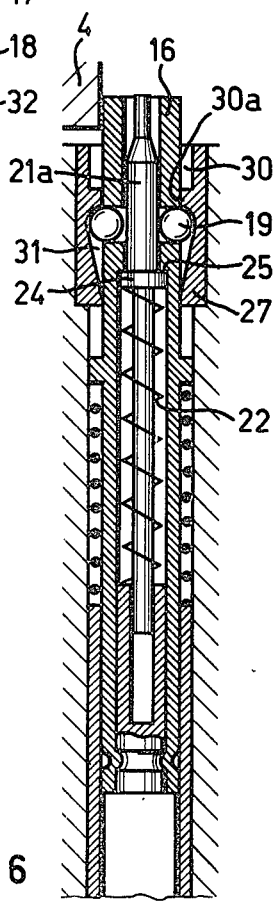
FIG. 6 is a view similar to the showing of FIG. 3 of the blocking mechanism in a still further position.

At its front end the sleeve 27 is provided with a first cylindrical recess 30. In the forward blocking position of the blocking sleeve 16, as shown in FIG. 3, the blocking bolt 21 which is likewise forwardly located presses the blocking balls 19 into the recess 30 and thus blocks the blocking sleeve 16. In the rearward position of the blocking sleeve 16, as shown in FIG. 5, the blocking balls 19 pressed apart by the blocking bolt 21 bear against the shoulder 29 in the fuze bore. The sleeve 27 is furthermore provided in the inner bore 28 with an inner or internal recess 31 having the shape of a surface of revolution which is coaxial to the sleeve 27. The generatrix of this surface of revolution is composed of approximately one-quarter of a circle, the radius of which is at least equal to the radius of the blocking balls 19 and a subsequent tangent which together with a surface line of the inner bore 28 i.e. with the blocking bolt axis encloses an acute angle and forms a wall **31*a* of the recess 31. The recess 31 tapers or narrows towards the rear. Forwardly there is formed a flange 30*a* between the recess 31 and the recess 30. The tangent of the aforementioned acute angle is smaller than the coefficient of friction for dry static friction between the balls 19 and housing sleeve 27. The largest depth of the recess 31 is chosen such that a blocking ball 19 bearing at its circular-shaped base contacts the enlarged or thicker portion 21*a* of the blocking bolt 21 (see FIG. 6**).

It would of course be possible to use other shaped blocking bodies, in which case the recess 31 would have to be appropriately constructed. For instance, there could be formed at the sleeve 27 a number of circumferentially distributed, wedge-shaped grooves.

According to the showing of FIG. 2 the transverse slide 4 laterally carries or is provided with teeth 35 which engage with a pinion 36 mounted in the bearing body 12. This pinion 36 is operatively connected through the agency of a transmission gearing 37 (see FIG. 1) with a not particularly illustrated but conventional flap or flutter element. The gearing 37 and the flutter element collectively form a retarding mechanism which delays the displacement of the transverse slide 4 from its blocked position into the armed position.

The mode of operation of the described apparatus is as follows:

Prior to firing of the projectile the transverse slide 4 of the fuze is held by the blocking mechanism 20 in its blocked position corresponding to the showing of FIGS. 1 and 3 in which the detonator cap 5 is located externally of the operative region of the firing pin 10. The blocking sleeve 16 is blocked in its first position. Upon firing of the projectile the blocking bolt 21 firstly is moved by virtue of its moment of inertia rearwardly against the force of the spring 22, thereby releasing the balls 19 and also the blocking sleeve 16 can move towards the rear against the force of the spring 18 due its moment of inertia. However, since the firing pin 10 moves towards the rear likewise against the force of the spring 7 in consequence of the acceleration appearing upon firing of the projectile and enters into the blind-hole bore 14 located coaxial therewith, the transverse slide 4, notwithstanding the release, remains in its blocked position due to the action of the blocking sleeve 16. At the moment when the projectile leaves the barrel the acceleration stops and the air resistance brings about a deceleration. The firing pin 10 again returns into its starting position and frees the transverse slide 4. Also the blocking sleeve 16 and the blocking bolt 21 have the tendency of returning back into their first blocking position. The conical portion 21*b* of the blocking bolt 21 however presses the balls 19 again into the radial bores 23 of the blocking sleeve 16 and such are pressed against the shoulder 29 in the fuze housing bore 17 which is formed by the sleeve 27, so that the blocking sleeve 16 remains blocked in the ready-to-fire position (see FIG. 5). The blocking bolt 21 bears with its collar 24 at the shoulder 25 of the blocking sleeve or bushing 16 and likewise does not protrude into the path of the transverse slide 4. The fuze is activated for firing or armed. The transverse slide 4 now slides under the action of the spring 5 into its armed position, and this movement owing to the action of the non-illustrated flutter body occurs at a speed corresponding to the desired safety conditions which should prevail when the shell is in front of the barrel mouth. Upon impact at the target the firing pin 10 is pressed into the detonator cap 5. By means of the explosive charge cord 39 the detonator 3 is ignited and by virtue of the latter there is equally ignited the actual explosive charge which has not been particularly shown in the drawing.

Figure 4:
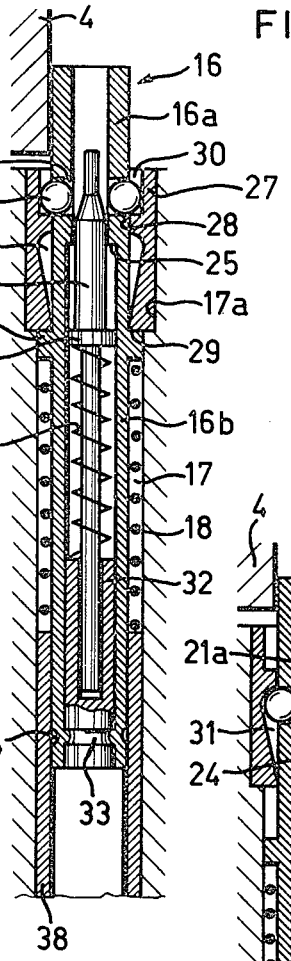
FIG. 4 is a view similar to the showing of FIG. 3 of the blocking mechanism with the blocking bolt in a further position.

If the projectile with the fuze in its non-armed or safety mode, as the same has been shown in FIGS. 1 and 3, experiences a brief deceleration, for instance when the projectile is dropped from a height of 5 meters onto a hard support surface with its tail-end leading, then the blocking bolt 21 is accelerated towards the rear and the blocking balls 19 are released for a moment (see FIG. 4). However, before the blocking bolt 21 can arrive at its rearmost position the deceleration has already terminated and the blocking sleeve 16 no longer strives to likewise shift towards the rear. The blocking bolt 21 again returns back into the forward position and presses the balls 19 back into the first recess 30. Consequently, the blocking sleeve 16 further remains blocked and blocks the transverse slide 4.

If, however, the projectile with the fuze unarmed is subjected to a greater deceleration, for instance upon dropping the projectile onto a hard surface from a height of 10 meters, then it can happen that the blocking sleeve or bushing 16 slides rearwardly to such an extent that the balls 19 arrive in the inner bore 28 of the sleeve 27 and penetrate into the recess 31. During the return forward movement of the blocking bolt 21 the conical portion 21*b* thereof presses the blocking balls 19 into the part of the recess 31 formed as one-quarter of a circle. The blocking bolt 21, while moving back the balls 19, shifts into its forward terminal position where it bears with its collar 24 at the shoulder 25 of the blocking sleeve 16 (see FIG. 6). During a further tail-end dropping of the projectile — for instance upon loading the projectile into the barrel of a mortar — but also upon firing the projectile, the blocking balls 19 are clamped, due to a very small rearward movement of the blocking bolt 21, between its portion 21*a* and the conical portion of the recess 31. The magnitude of the frictional force thus exerted upon the blocking bolt portion 21*a* assisted by the force of the spring 22 prevents a further rearward movement of the blocking bolt 21. The now non-movable blocking bolt 21 no longer permits the balls 19 to move inwardly and to free the blocking sleeve 16 for rearward movement. The blocking sleeve 16 remains in a second position where it still blocks the transverse slide 4, and specifically not only during further transport but also during firing. This means that with a so-called "semi-arming" of the fuze during a first fall of the projectile the latter is made a dud, i.e. that detonation of the explosive charge is not possible. Hence, the gunnery crew or otherwise during firing such semi-armed projectiles are no longer placed in danger.

While there are shown and described present preferred embodiments of the invention, it is to be distinctly understood that the invention is not limited thereto, but may be otherwise variously embodied and practiced within the scope of the following claims. Accordingly,

What is claimed is:

1. A blocking mechanism for an impact fuze comprising a fuze housing, a blocking sleeve mounted to be lengthwise displaceable within the fuze housing, means for spring-loading the blocking sleeve, said blocking sleeve being provided with at least one radially movable blocking body, a blocking bolt lengthwise displaceable within the blocking sleeve for bringing the blocking body into a position blocking the blocking sleeve in the fuze housing, means for spring-loading the blocking bolt, said fuze housing having a recess into which there can engage the blocking body for blocking the blocking sleeve in a first position, said fuze housing having a further substantially wedge-shaped recess tapering towards the rear of the fuze housing, said further recess having a wall, the blocking body in a second position of the blocking sleeve being clampable between the wall of the further recess and the blocking bolt for securing the blocking bolt against rearward displacement.

2. The blocking mechanism as defined in claim 1, wherein said wall together with the lengthwise axis of the blocking bolt encloses an acute angle, the tangent of which is smaller than the coefficient of friction of dry static friction between the blocking body and the wall.

3. The blocking mechanism as defined in claim 1, wherein the further recess possesses the shape of a surface of revolution, the generatrix of which comprises approximately one-quarter of a circle and a rearwardly merging tangent located in said wall.

4. A blocking mechanism for an impact fuze comprising a fuze housing having a front end and a rear end, a blocking sleeve mounted to be lengthwise displaceable within the fuze housing, means for resiliently loading the blocking sleeve, said blocking sleeve being provided with at least one radially movable blocking body, a blocking bolt lengthwise displaceable within the blocking sleeve for bringing the blocking body into a position blocking the blocking sleeve in the fuze housing, means for resiliently loading the blocking bolt, said fuze housing having means defining a recess into which there can engage the blocking body for blocking the blocking sleeve in a first position, said fuze housing having means defining a further recess tapering towards the rear end of the fuze housing, said further recess including a wall, the blocking body in a second position of the blocking sleeve being held between the wall of the further recess and the blocking bolt for securing the blocking bolt against rearward displacement.

* * * * *